US006223903B1

(12) United States Patent
Mansouri

(10) Patent No.: US 6,223,903 B1
(45) Date of Patent: May 1, 2001

(54) COLLAPSIBLE SHIPPING CONTAINER

(76) Inventor: Hossein Mansouri, 14945 Richmond Ave. Apt. #626, Houston, TX (US) 77082

( * ) Notice: Subject to any disclaimer, the term of this patent is extended or adjusted under 35 U.S.C. 154(b) by 0 days.

(21) Appl. No.: 09/517,867

(22) Filed: Mar. 2, 2000

(51) Int. Cl.[7] ..... B65D 19/06; B65D 25/14; B65D 5/06

(52) U.S. Cl. ..... 206/600; 220/4.16; 220/495.06; 220/666; 222/105; 222/183; 279/117.3

(58) Field of Search ..... 206/386, 600; 222/105, 183, 541.1; 220/4.16, 495.01, 495.06, 666; 229/117.3

(56) References Cited

U.S. PATENT DOCUMENTS

| | | | | |
|---|---|---|---|---|
| 4,623,072 | | 11/1986 | Lorenz . | |
| 4,793,519 | * | 12/1988 | Voorhies, Jr. | 206/386 |
| 4,930,661 | * | 6/1990 | Voorhies | 206/386 |
| 5,265,753 | * | 11/1993 | Moorman | 229/117.3 |
| 5,269,414 | * | 12/1993 | D'Hollander | 206/600 |
| 5,348,186 | | 9/1994 | Baker . | |
| 5,353,982 | | 10/1994 | Perkins et al. . | |
| 5,356,079 | * | 10/1994 | Hogan | 229/117.3 |
| 5,799,812 | * | 9/1998 | Mansouri | 206/600 X |
| 5,813,562 | | 9/1998 | Perkins . | |
| 6,000,549 | | 12/1999 | Perkins . | |

* cited by examiner

*Primary Examiner*—Bryon P. Gehman
(74) *Attorney, Agent, or Firm*—Michael B. Jolly

(57) ABSTRACT

A collapsible bulk shipping container for shipping and storing liquids or free flowing materials, with a foldable wall structure constructed of one continuous cardboard or fiber board structure. Score, crush, or foldable flaps divide the wall structure into separate wall members and allow the wall structure to be folded flat. The wall structure is hingedly attached to a base panel which is securely attached to a standard wooden pallet. The pallet is standard with a raised outer lip which retains a lower section of the assembled walls and which includes a bottom discharge cutout for discharging the contained material from a plastic liner. The liner includes an inlet port and an outlet port while the inlet port is retained near a top edge of one wall member for convenience with a filler neck tab permanently attached near a top edge of one of the walls. A container topcap is strapped over the filled container with retention straps which serve to add structural integrity to the filled container while also further securing the filled container to the pallet. The folded container fits easily on a standard pallet and is easily assembled and filled.

5 Claims, 5 Drawing Sheets

COLLAPSIBLE SHIPPING CONTAINER

FIELD OF THE INVENTION

The present invention relates to collapsible bulk shipping containers and more particularly to a collapsible bulk shipping container for shipping and storing liquids or free flowing materials, wherein the walls of the container are constructed of one continuous cardboard or fiber board wall structure with score marks for folding flat and which is hingedly attached to a base panel which is securely attached to a standard wooden pallet, wherein the pallet includes a raised outer lip which retains the lower section of the constructed container walls and and which includes a bottom discharge cutout for discharging the contained material from a plastic liner contained within the container, and wherein an inlet port of the plastic liner is retained for convenience with a filler neck tab attached near a top edge of one of the walls, a container top cap is strapped over the filled container with retention straps which serve to also add structural integrity to the filled container while also further securing the filled container to the pallet.

BACKGROUND OF THE INVENTION

Numerous collapsible intermediate bulk containers have been developed for shipping liquid and free flowing material which are constructed of cardboard or fiber board. Many of these containers are adapted to utilize a disposable liner which is an inner plastic bag that contains the shipped material while the bag is confined within the container, the bags are generally disposed after use. The prior art containers frequently utilize a standard pallet or a built in pallet, and are collapsible, so that after the shipment has been received and the contents emptied from the disposable liner, the container is disassembled and secured for shipment back to the supplier or recylced. The usual practice is to utilize an inner disposable plastic liner or plastic liner in a cassette, which has an inlet port and an outlet port. After the collapsible shipping container has been assembled, the user is required to bend over the opening of the container and insert the plastic liner outlet port through the outlet opening of the container, this task is difficult if not impossible for some persons. Another problem encountered with collapsible containers is that the folded size of the container is sometimes larger than the size of the pallet, making shipping the folded container cumbersome. Assembling a collapsible container may be difficult for many person, since many of the existing collapsible containers include many loose pieces that are not interconnected or include interconnected pieces which require numerous sequential folds in order to properly assemble the container. The present invention overcomes many of these and other problems by providing a substantially square or rectangle collapsible bulk shipping container for either shipping and storing liquids or free flowing materials, wherein the walls of the container are interconnected and constructed of one continuous multilayer cardboard or fiber board structure, forming a wall structure. Score marks for folding the wall structure flat, similar to an accordion, are provided at each wall side edge and on two opposing walls vertically about midway between both side wall edges, the wall structure is hingedly attached to a bottom base member along a bottom edge of one wall and which is securely attached to a standard wooden pallet. The pallet includes a raised outer lip around its perimeter which retains the lower section of the assembled container walls and which includes a bottom discharge cutout for discharging the contained material from a plastic insert contained within the container. The folded wall structure fits within and is retained within the raised lip of the pallet with a container cap for easy shipping. The folded wall structure is easily assemble by first lifting the folded wall structure from a wall top edge and opposite the hingedly secured bottom edge and pulling the accordion folded wall structure until the walls form upright outer walls for the container. An inner plastic liner is provided in place with an outlet port extending through a wall outlet opening and with its inlet port attached to a filler neck tab which is attached to an upper edge of one wall. Once the inner plastic liner is filled, a container cap is placed over the container and straps extending around the filled container and the top cap restrain the container to the pallet and further added structural integrity to the container system.

The prior art collapsible containers include U.S. Pat. No. 6,000,549 to Perkins, which describes and claims a container with a flexible liner, a plurality of vertical rigid support walls, and a flexible skin interconnecting the rigid walls. This container system is useful for its stated purposes but it does not provide an easily assembled collapsible container as the present invention, nor will a folded version of the 549 patent fit easily on a standard sized pallet.

U.S. Pat. No. 5,813,562 to Perkins describes and claims a container with an insertable inner liner and with knock out portions near a bottom providing discharge methods and apparatus.

U.S. Pat. No. 5,353,982 to Perkins et al, describes and claims a fluent container with discharge secured to the bottom of the container, wherein the container maybe folded flat for storage or shipping.

U.S. Pat. No. 5,348,186 to Baker describes and claims a foldable tubular shell shipping container.

U.S. Pat. No. 4,623,072 to Lorenz describes and claims foldable corrugated containers with at least one foldable flap attached at the fold line rather than crushing or scoring the corrugated material to form the fold line.

The prior art patents do not provide a collapsible shipping container that is permanently attached to a standard size pallet, may be constructed to form a substantially square or rectangular shipping container, includes a wall structure that forms numerous walls from continuous material and is scored, crushed or includes foldable flaps that allow the wall structure to be folded flat and easily fit on a standard size pallet, includes an inner plastic liner for containing material therein within the folded wall structure with an outlet port extending through an opening of the wall structure and an inlet port attached to a filler neck tab positioned on a top edge of one wall for easily filling the container, and wherein the container is easily assembled by lifting the folded container upwardly and extending the folded wall sections forming the square or rectangular wall container, and wherein the assembled container is retained on a regular size pallet with a raised perimeter lip and where a container cap with numerous straps further secures the filled container to the pallet.

It is accordingly an object of the present invention to provide a collapsible bulk shipping container suitable for shipping liquid and other fluent suitable for use with a standard industry pallet and which includes a bottom discharge port, an top inlet port and an inner liner contained and supplied therewith.

It is a further object of the present invention to provide a collapsible bulk shipping container that includes a wall structure constructed of continuous cardboard or fiber board whereby wall members are formed by vertically aligned score lines, crush lines or foldable flaps, and where the wall structure folds to a substantially flat horizontal position on a top surface of a standard size pallet.

It is a still a further object of the present invention to provide a collapsible bulk shipping container that includes a collapsible wall structure which forms four wall members of a substantially square or rectangular shipping container, the wall members are foldable along vertically orientated lines which allow the wall structure to be folded accordion style for storage and assembly, the container has an open top wherein and inner plastic liner is inserted with an outlet port extending through a wall member and an inlet port captured by a inlet opening flap attached to a top edge of a wall member, while a perimeter lip is provided around a bottom perimeter portion of the assembled wall structure to secure the container to the pallet and a skirted top cap fitted over the assembled and filled container and secured in place by multiple straps which extend around the top cap and pallet.

The invention provides an easy to fill collapsible container which is discarded or recycled when empty. The collapsible container is also easier to assemble than existing collapsible containers since the heavy wall panels are hingedly pivoted to an upright position and the base panel is securely attached to the top surface of the pallet. The present invention also folds to a size no larger than a standard size pallet and is accordingly easier to store and ship.

DETAILED DESCRIPTION OF THE DRAWINGS

Figure 1:
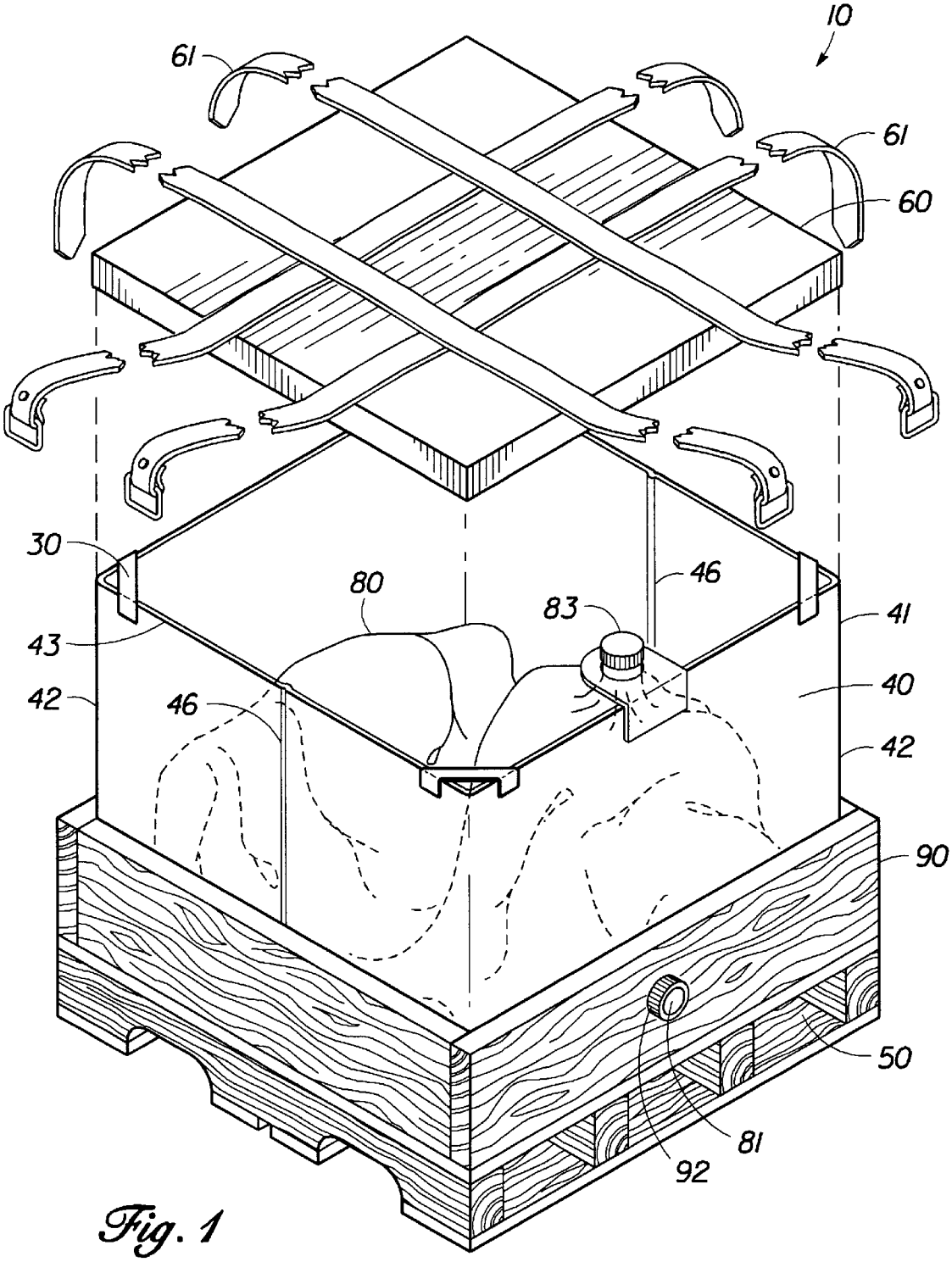
FIG. 1 is a perspective and partially exploded view of the collapsible bulk shipping container illustrating the assembled wall structure, inner liner placed within, placement of the skirted top cap and shipping securing straps.

It can be seen from the following description that the collapsible bulk shipping container includes main components: wall structure 20, wall members 40, pallet 50, skirted top cap 60, inner liner 80, base panel 70, and perimeter lip 90. The term "standard pallet" is meant to include a pallet size normally used in the shipping industry and may include any number of dimensions, the use of the term "standard pallet" is not meant to limit in any way the size which the present invention may be constructed. "Standard pallet" also is not meant to limit the present invention to any particular pallet material or design.

Figure 5:
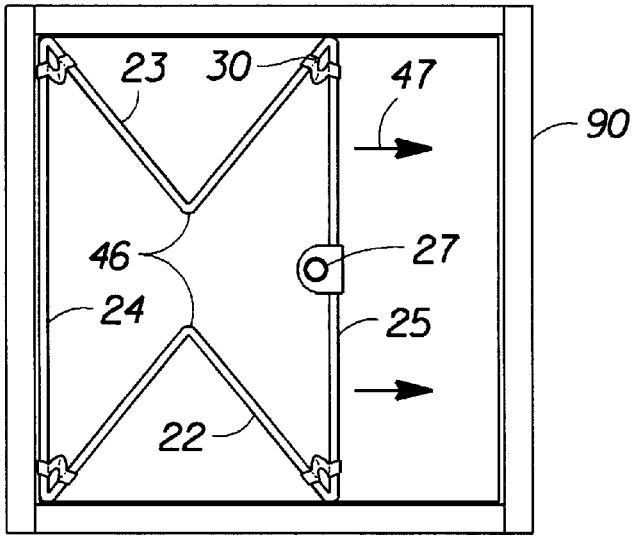
FIG. 5 is a top view of the pallet and collapsible bulk shipping container wall structure with the wall structure about half way unfolded in an accordion fashion in the direction of the arrows.
Figure 6:
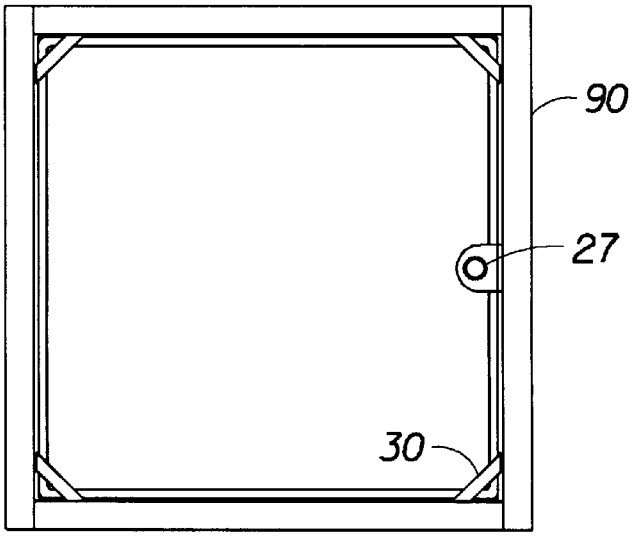
FIG. 6 is a top view of the pallet and the collapsible bulk shipping container wall structure with the wall structure fully unfolded so that adjacent walls are 90° in relation to one another.
Figure 7:
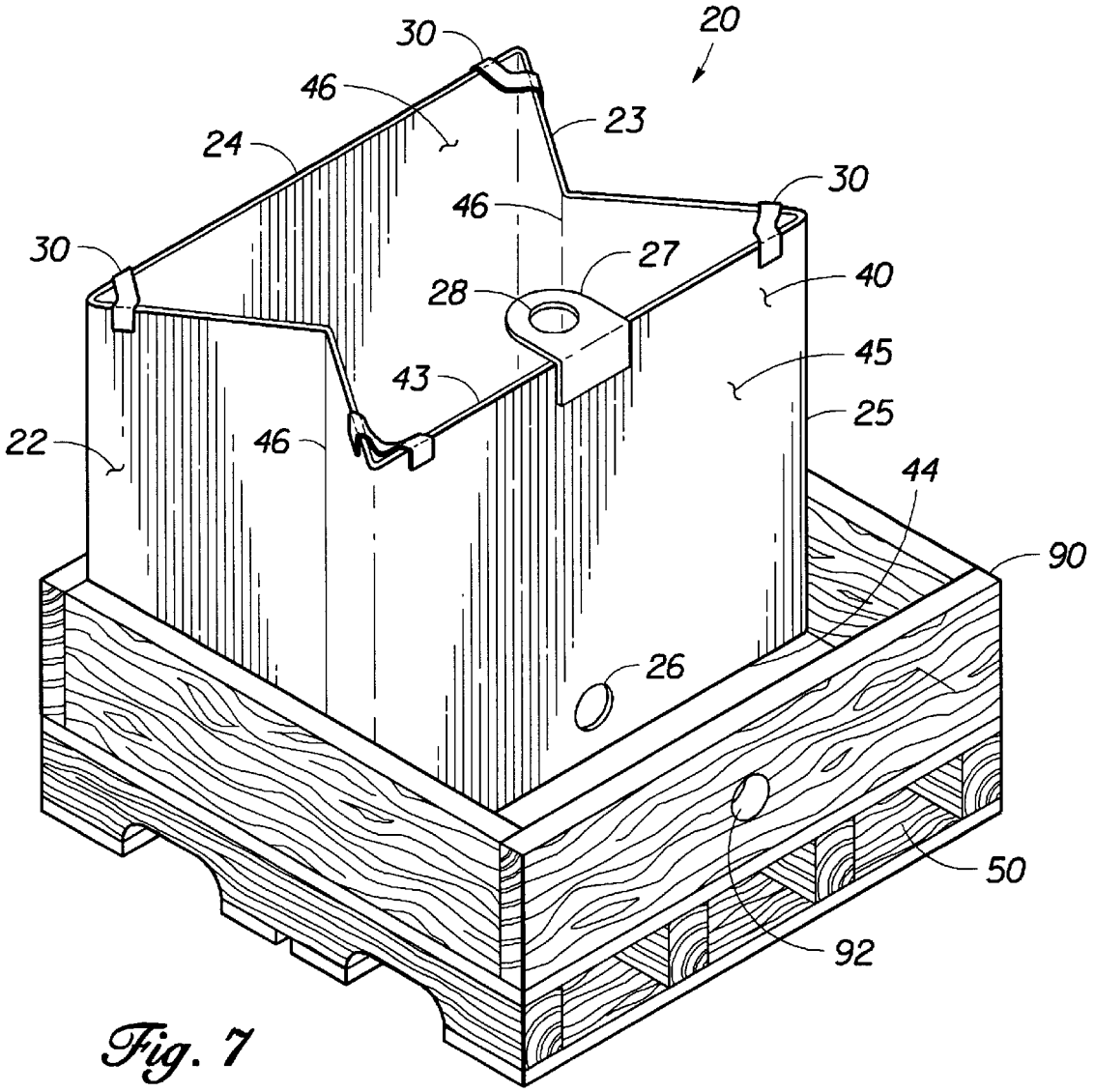
FIG. 7 is a perspective view of the wall structure about half way unfolded as illustrated in FIG. 5.
Figure 8A:
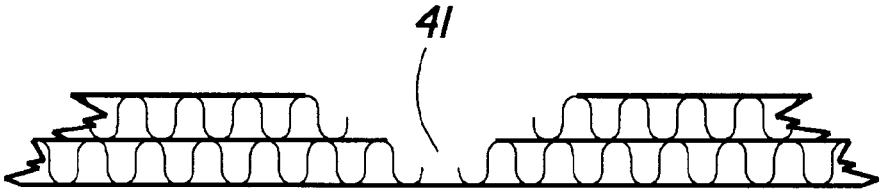
FIGS. 8*a–c* are cross section views of various means for forming fold lines in multilayer card board including scoring 8*a*, crushing 8*b*, and a fold flap 8*c*.
Figure 8B:
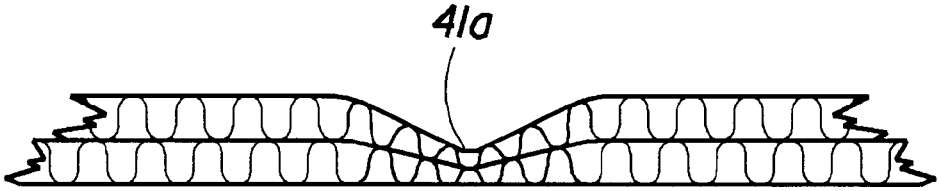
Figure 8C:
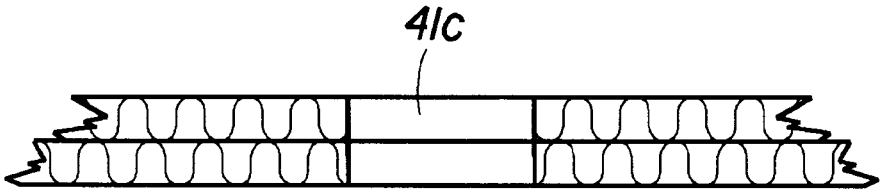

FIG. 1 generally sets forth the collapsible bulk shipping container 10 and its components. The wall structure 20 is constructed of continuous material preferably multiple ply cardboard or fiber board. The wall structure 20 forms four wall members 40 vertically oriented and separated by scored, crushed, or fold flaps forming vertical fold lines. The wall members 40 each include; side edges 42, top edge 43, bottom edge 44, exterior surface 45 and interior surface 46. The wall members 40 may be constructed of dimensions necessary to achieve a desired volume for the container and are preferable constructed of a dimension to conveniently fit on a pallet to be utilized. FIGS. 8*a–c* illustrate various means for forming fold lines and folding the wall members 40 along the side edges and may include a score line 41, a crush line 41*a*, or a foldable flap 42. The crush line or foldable flap are the preferred means for forming the fold line since they result in a stronger fold structure. The foldable flap 41*c* is described in detail by Lorenz in U.S. Pat. No. 4,623,072 and the description of which is incorporated herein by reference. In addition to providing fold lines along each side edge of each wall member, two opposing wall members include a vertical mid way fold line 46 positioned about mid way between side edges, vertically orientated and parallel to the side edges. The vertical mid way fold line 46 allows two opposing wall members 22 and 23, to be folded in half vertically, so that the upright wall structure 20, and the wall members 40 may be folded together similar to an accordion, set forth in FIGS. 4, 5, 6, and 7. The two opposing wall members 22 and 23, with the vertical mid way fold line 46 are folded outwardly in the direction of arrows labeled 47 on FIG. 5 to assemble the wall structure on the pallet. The two opposing wall members without vertical mid way fold lines are labeled 24 and 25. An outlet opening 26 is positioned near a bottom edge 44 of wall member 25 and provides an opening for an outlet port 81 of the inner liner 80. An inlet port flap 27 is adhesively secured near a top edge 43 of wall member 25 and includes an opening 28 for receiving and capturing inlet port 83 of inner liner 80. Inner liner 80 is preferably plastic and inert to the material to be shipped and includes the inlet and outlet port with a given volume suitable for the container dimensions. The liner 80 is preferably supplied with the collapsible container with the inlet and outlet ports secured in place through the inlet and outlet openings. This is possible even when the container is collapsed. Diagonal support straps 30 are adhesively secured on an exterior surface 45 near a top edge 43 and near fold line of each wall member 40. The support straps 30 extend diagonally from one wall member to an adjacent wall member draped over the top edge and are a length that allows the wall members to be unfolded to a 90° orientation to one another. The support straps serve to increase the structural integrity of the filled container.

The pallet 50 includes a perimeter lip 90 which a raised wall extending around the perimeter of the pallet which provides a support for the bottom end of the wall members of the filled container. The perimeter lip may either be formed as part of the pallet 50 and securely attached to the pallet or a part of base panel 70. The perimeter lip is preferably about 4 to about 8 inches in height and includes a outlet opening 92 for allowing the outlet port to be accessed form a recess that provides protection from fork lifts and the like.

Figure 2:
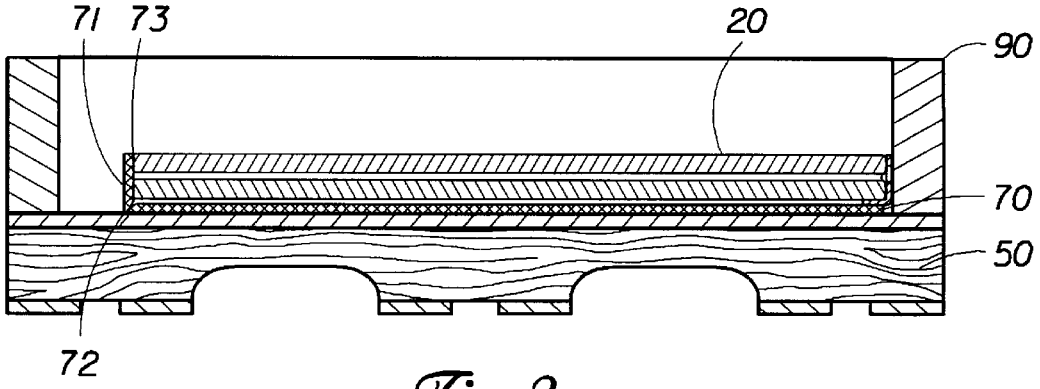
FIG. 2 is a side cross section view of the collapsible bulk shipping container with the wall structure folded in a horizontal position on the pallet top surface.
Figure 3:
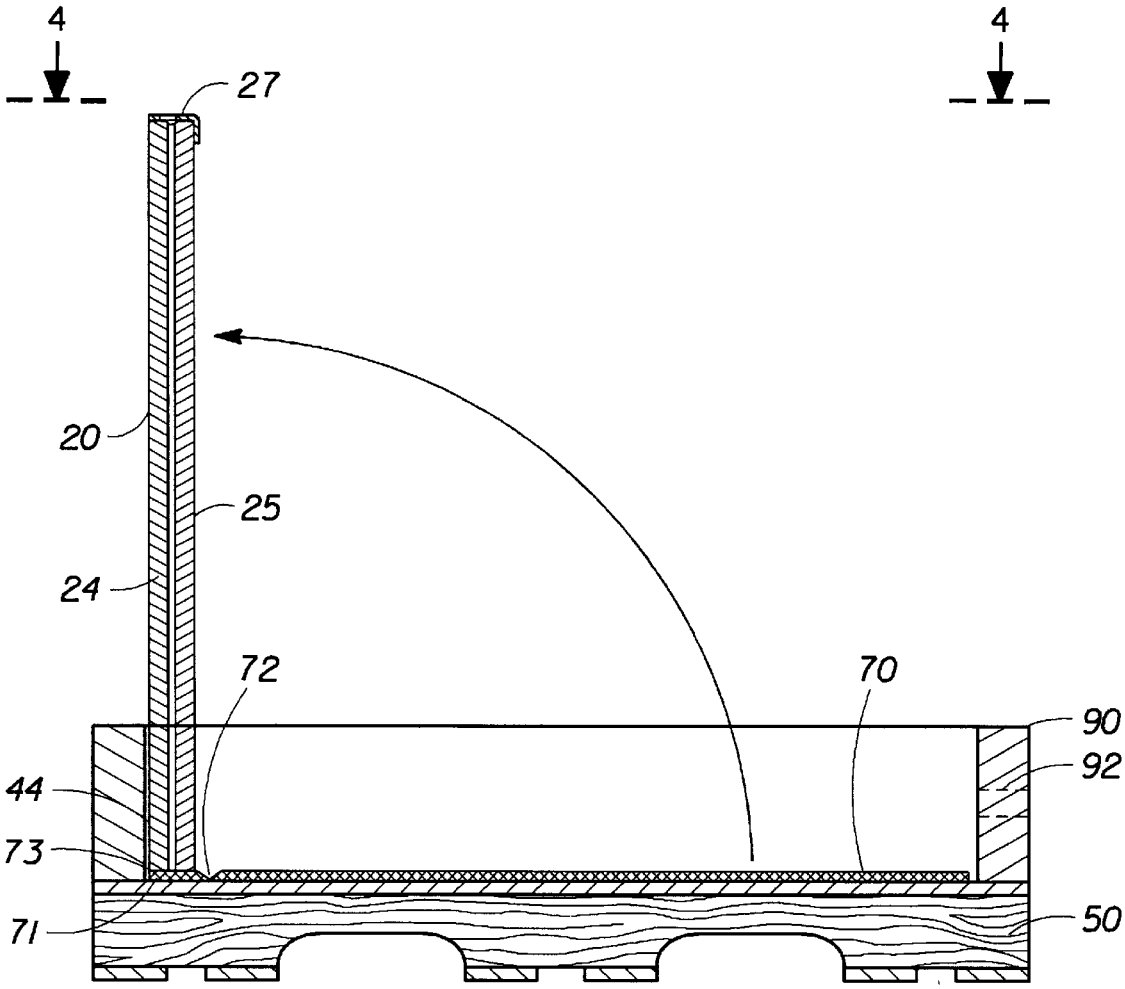
FIG. 3 is a side cross section view of the collapsible bulk shipping container with the wall structure raised to a vertical position readied for unfolding the wall members.
Figure 4:
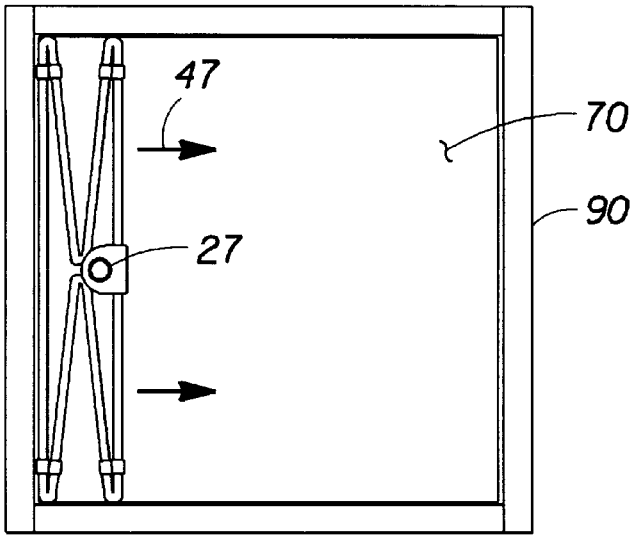
FIG. 4 is a top view of the pallet and collapsible bulk shipping container wall structure with the wall members starting to unfold in an accordion fashion in the direction of the arrows.

Base panel 70 forms a floor for the assembled container and is securely attached to the pallet top surface while a length of one edge is not secured to the pallet forming a hinge flap 71. The base panel 70 is illustrated in FIGS. 2 and 3 and is constructed of material similar to the wall structure 20 but does not necessarily need to be as robust. The hinge flap 71 is formed by a fold line 72 which may be formed as set forth above and illustrated in FIGS. 8*a–c*, the hinge flap outer edge 73 is securely attached to an bottom edge 44 of wall member 24, and the length of the hinged flap is about equal to the height of the wall structure when fold flat in a horizontal position. The hinge flap 71 operates by the user first lifting the horizontally positioned wall structure 20 as illustrated in FIG. 2 from inlet port tab 27 and in the direct of the arrow on FIG. 3. When the wall structure 20 is vertical, and perpendicular to the top surface of the pallet, wall member 25 is than scooted in the direction indicated by arrows 29 on FIGS. 4 and 5, thereby unfolding the wall members 22 and 23, until wall member 25 reaches the perimeter lip 90, thereby assembling the wall structure.

A skirted top cap 60 is provided with the container and is an integral part of the structural integrity of the filled and secured container. The top cap 60 is dimensioned to fit over the outside top edge of the assembled and filed container and is secured in place by multiple securing straps 61 which extend around the bottom of the pallet and the top cap. The top cap is constructed of material similar to the other components of the container.

The present invention has been tested and passed industry standard performance test procedures including a vibration test, horizontal impact, drop test, and compression test.

I claim:

1. A collapsible bulk shipping container suitable for shipping fluent material with a standard size pallet, comprising:

a) a foldable wall structure comprising four vertical wall members each with side edges, a top edge, a bottom edge and an exterior surface, the vertical wall members interconnected along each side edge and constructed of continuous material forming the foldable wall structure, a means for folding the vertical wall members along each side edge and wherein two opposing vertical wall members include a vertical midway fold line and which includes a means for folding along a vertical line parallel and about midway between each side edge so that the wall structure folds similar to an accordion forming a flat folded wall structure, an outlet opening positioned near a bottom edge of one wall member without a vertical midway fold line, a diagonal support strap positioned near each top corner of each wall structure and each support strap adhesively secured to an exterior top edge of a wall member and extending to and adhesively secured to an adjacent wall member exterior top edge and wherein each diagonal support strap has a length dimensioned to allow adjacent wall members to unfold to a 90° orientation, an inlet port retention flap attached to an exterior surface near the top edge of a wall member without a vertical midway fold line, b) a base panel securely attached to a top surface of the pallet with one edge of the base panel remaining unsecured to the pallet top surface forming a hinge flap and wherein the foldable wall structure is hingedly secured to the hinge flap along a bottom edge exterior surface of one wall member without a vertical midway fold line and which wall member is orientated on top of a horizontally positioned folded wall structure, c) a perimeter retainer lip extending vertically from a top surface near an outside perimeter edge of a pallet forming an exterior perimeter of the wall structure, d) an inner liner with a outlet port extending through an outlet opening, and an inlet port extending through and captured by the inlet port retention flap, and e) a skirted top cap dimensioned to fit around and on top of the assembled wall structure which is secured in place utilizing shipping securing straps which are wrapped around the container top and through the pallet thereby securing the container top and securing the container on the pallet.

2. The collapsible bulk shipping container as set forth in claim 1 wherein the perimeter retainer lip is securely attached to the base panel and the pallet top surface.

3. The collapsible bulk shipping container as set forth in claim. 1 wherein the means for folding the vertical wall members along each side edge further comprises a scored vertical line separating each wall member and forming a fold line between each wall member.

4. The collapsible bulk shipping container as set forth in claim 1 wherein the means for folding the vertical wall members along each side edge further comprises a crushed vertical line separating each wall member and forming a fold line between each wall member.

5. The collapsible bulk shipping container as set forth in claim 1 wherein the means for folding the vertical wall members along each side edge further comprises a foldable flap forming a vertical fold line separating each wall member and forming a fold line between each wall member.

* * * * *